United States Patent [19]

Bottoms

[11] 4,397,893

[45] Aug. 9, 1983

[54] SYSTEM FOR FLAME SPRAY COATING OF A ROD

[76] Inventor: Clifford C. Bottoms, Rte. 2 Box 184L, McKinney, Tex. 75069

[21] Appl. No.: 299,724

[22] Filed: Sep. 8, 1981

[51] Int. Cl.[3] ..... B05D 1/08

[52] U.S. Cl. ..... 427/319; 118/58; 118/320; 118/321; 118/323; 118/500; 427/423; 427/425

[58] Field of Search ..... 427/34, 319, 359, 423, 427/425; 118/58, 72, 323, 320, 321, 500

[56] References Cited

U.S. PATENT DOCUMENTS

| | | | |
|---|---|---|---|
| 1,281,407 | 10/1918 | Marquess | 118/321 |
| 1,666,044 | 4/1928 | Danziger | 118/500 |
| 1,947,493 | 2/1934 | Rose et al. | 427/425 |
| 2,316,959 | 4/1943 | Hinkley et al. | 118/321 |
| 2,890,678 | 6/1959 | Way et al. | 118/321 X |
| 3,397,732 | 8/1968 | Howell | 427/425 |
| 3,399,649 | 9/1968 | Kidgell et al. | 118/321 |
| 4,099,481 | 7/1978 | Lyons | 118/321 |
| 4,207,356 | 6/1980 | Waugh | 427/425 |

*Primary Examiner*—Shrive P. Beck

*Attorney, Agent, or Firm*—Freilich, Hornbaker, Wasserman, Rosen & Fernandez

[57] ABSTRACT

A system is described for coating a cylindrical surface of a long thin workpiece by a process which includes flame spray coating that heats the workpiece to a large portion of its melting temperature and which is followed by grinding of the coated cylindrical surface, which produces a final coated surface of more uniform coating thickness than heretofore. The workpiece is rotated about a vertical axis, to avoid slight bending deformation of it, the upper end of the workpiece is allowed to move slightly towards and away from its opposite end, and an upward bias is applied to the chuck device that engages the upper end of the rotating workpiece to avoid column-like buckling of it.

5 Claims, 3 Drawing Figures

SYSTEM FOR FLAME SPRAY COATING OF A ROD

BACKGROUND OF THE INVENTION

Flame spray coating is commonly used to apply wear-resistant coatings to steel parts. Such parts may be first heated to a temperature such as 2100° F., which is a large portion of the typical melting temperature of steel such as 2700° F., the heating being followed by flame spraying or plasma flame spraying. A long thin workpiece such as a piston rod of a high pressure mud pump for oil well drilling, may be coated by holding it on a lathe and rotating it while a heat gun slowly passes along it. When the rod is sufficiently heated, a flame spray gun is slowly passed back and forth along a portion of the rod which is to be coated. When the rod has cooled it is cylindrically ground. During the heating and flame spraying, the rod may become slightly bent, so that a coated middle portion may become non-concentric with the cylindrical ends of the rod. As a result, grinding of the middle portion to a true cylindrical surface concentric with its ends, may result in the coating on one side of the rod being ground much thinner than the coating on the other side. For example, a hollow rod or pipe of three inches diameter and 50 inches length may be bent so its coated middle is displaced 25 mil (one mil equals one thousandth inch). After grinding the coated cylindrical surface true with the rest of the rod, the coating will be of unequal thickness, being perhaps 100 mil thick on one side and 50 mil thick on the other due to the 25 mil bending of the rod. Since the lifetime of wear may depend upon the minimum thickness of the coating, such uneven coating would reduce the service life of the rod. To prevent this, a thicker coating has to be applied, and a longer grinding operation has to be conducted to grind the rod true. A system which minimized such unevenness, would be of considerable benefit in the flame spray coating of long thin workpieces.

SUMMARY OF THE INVENTION

In accordance with one embodiment of the present invention, a method and apparatus are provided for the coating of cylindrical surface portions of long and thin workpieces by flame spraying processes that heat the workpiece to a large proportion of its melting temperature, which minimize irregularity in the coating thickness of the final ground device. A system for such coating includes chuck devices for holding and rotating the workpiece, with the chuck devices positioned so the workpiece axis extends vertically. The vertical orientation avoids beam-like deflections of a horizontal workpiece when subjected to a temperature that approaches its melting temperature. The workpiece is held so it can expand and contract along its length while being supported at its opposite ends, and a tension preload can be applied to compensate for some of the weight of the chuck device and/or workpiece.

The novel features of the invention are set forth with particularity in the appended claims. The invention will be best understood when read in conjunction with the accompanying drawings.

DESCRIPTION OF THE PREFERRED EMBODIMENTS

Figure 1:
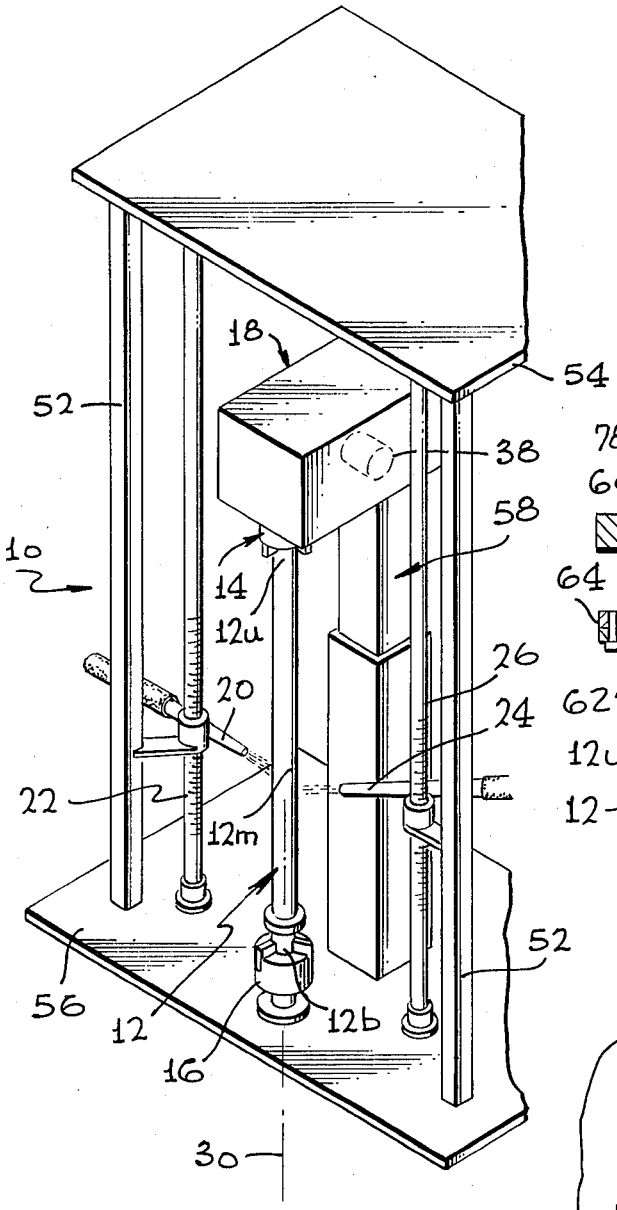
FIG. 1 is a perspective view of a flame spray coating apparatus constructed in accordance with the present invention.

FIG. 1 illustrates a system 10 for flame spray coating of a workpiece 12 which is relatively long and thin, that is, with a length at least about ten times its diameter, such as a piston of a high pressure pump. The rod 12 is cylindrical along almost all of its length, including its opposite ends 12*u*, 12*b* and its middle portion 12*m*. The rod is held at its opposite ends by upper and lower chucks 14, 16 that can rotate, and with the upper chuck 14 being rotatably driven by a drive mechanism 18. In order to flame spray the middle portion 12*m* of the rod, the rod is first heated by a heating gun 20 that is mounted on a lead screw 22 that is rotatably driven to move the gun up and down along the rod. After the rod has been heated to the appropriate temperature, the heat gun 20 is deenergized, and a plasma flame spray gun 24 is energized. The spray gun 24 is mounted on another lead screw 26 which rotatably driven to move the spray gun up and down along the selected portion of the rod that is to be flame spray coated.

After the middle portion 12*m* of the rod has been flame spray coated, the coated portion must be ground smooth and coaxial with the opposite cylindrical end portions 12*u*, 12*b* of the rod. This can be accomplished by mounting the rod on a grinding machine where it is rotated about the axes of the opposite rod ends 12*u*, 12*b* while a grinding wheel is applied to the coated middle portion.

An important problem that can arise in the flame spray coating of objects such as the rod 12, is that the coated portion such as 12*m* may become slightly deformed from its original position with respect to the ends such as 12*u*, 12*b*. In that case, the grinding process which grinds the middle portion 12*m* so it is "true", or in other words concentric with the rest of the rod such as the opposite ends, will have to grind one side of the middle portion 12*m* more than the other side. As a result, one side of the rod along the middle portion 12*m* will have a much thinner coating than the other side. Considerable sideward deflections have occurred in the prior art wherein a workpiece such as the rod 12 was laid on a typical horizontal lathe for heating and then flame spray coating. In such prior art methods, a rod of perhaps 6 feet length and four inches diameter might experience a deflection of perhaps 25 mil (one mil equals one thousandth inch) after being subjected to a temperature of about 2100° F. which is a large portion of the melting temperature of steel of about 2700° F. Where the flame spray coating would otherwise be ground to a 75 mil thickness just to achieve smoothness, it would be found that the coating on one side of the rod might be only 50 mil thick while the other side was 100 mil thick, because of the rod deflection. Of course, the reduced thickness can be avoided by applying a much thicker coating, but the amount of rod deflection is not accurately predictable, and considerable expense is involved in grinding a much greater thickness of material from the rod as well as in initially applying the coating.

In accordance with the present invention, the rod or other workpiece is rotatably mounted so that its axis 30 is vertical instead of horizontal. The vertical orientation can avoid even small sideward deflection, because a rod under compressive or column-like loading will not experience significant deflections so long as the loading is less than a critical value. This is very different from the phenomenon of bending, as in the case of a horizontally-extending rod which is loaded by its weight, and wherein the rod will begin to deflect as soon as any bending load is applied. The heating gun and flame spray coating devices do not apply any appreciable sideward bending forces to the rod, and so long as the compressive loading of the rod is less than a critical value, there will be very little sideward deflection of the middle portion of the rod. Thus, by orienting the rod vertically instead of horizontally, sideward deflection can be avoided, and the consequent possibility of greatly uneven coating thicknesses and of any need for applying a much greater coating thickness followed by large coating removal by grinding, is avoided.

Figure 2:
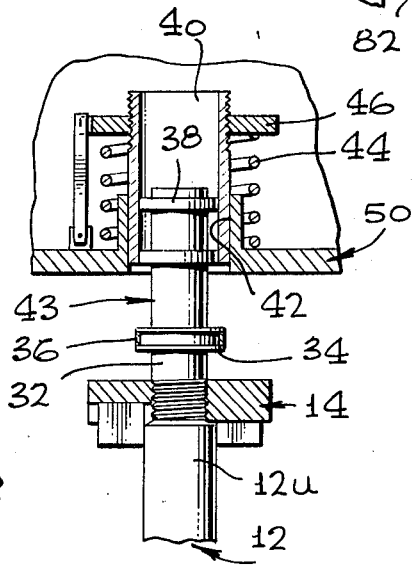
FIG. 2 is a partial sectional side view of the apparatus of FIG. 1.

The rod 12 expands considerably when heated to a high temperature. Since opposite ends 12*u*, 12*b* of the rod are each securely held to a rotating chuck 14, 16, one of the chucks 14 is mounted so it can move vertically. As shown in FIG. 2, the chuck 14 is mounted on a shaft 32 which holds a sheave 34 driven by a belt 36 that is connected to a motor 38. The rotating shaft is connected through bearings 38 to a non-rotating column 40. The column 40 can slide vertically within a guide hole 42, to thereby permit the rotating chuck 14 and the upper end 12*u* of the shaft to move vertically by a limited amount. The entire mechanism including the chuck 14, shaft 32 and column 40 may be referred to as chuck device 43. The chuck devices 43, 16 are vertically spaced by more than the maximum diameter of a workpiece that they can hold. In order to avoid a compressive load on the rod 12 that might approach the critical buckling load at the high temperature of the rod, a constant upward force is applied to the column 40 by a preloaded spring 44. The spring is compressed between a plate 46 engaged with the column 40 and threadably adjustable in position thereon, and the moveable portion of the frame 50 of the machine which forms the guide hole 42. The spring force can be adjusted to apply an upward force to the column 40 equal to the weight of the chuck device 43 attached to the top of the rod 12, and that would otherwise constitute a compressive load on the rod. The spring force can be adjusted to provide an additional upward force that counteracts some of the weight of the column on itself to further avoid loading of the column.

The entire system of FIG. 1 includes several posts 52 that support a top plate 54 over a bottom plate 56. The lead screws 22, 26 which move the heat gun and flame spray gun, extend between these plates. A telescoping post assembly 58 supports the rod driving mechanism 18 above the lower plate 56, and enables adjustment of the separation between the chucks 14, 16 to enable them to accommodate workpieces of a variety of heights. In one example, a rod 12 which serves as part of a piston of a high pressure mud pump used in oil well drilling, has a diameter of 3½ inches and a length of 57 inches. The heat gun 20 is slowly moved up and down along the rod for a period of about 3 minutes while the rod rotates at about 75 rpm, until the rod has been heated to about 2100° F. The plasma flame spray gun 24 is then energized and slowly moved up and down along the rod for another period of about 3 minutes to apply a coating to the rod of about 100 mil. After the rod cools, it is removed from the apparatus and placed on a conventional lathe with a grinding attachment thereon and the rod is then ground so that its spray coated middle portion 12*m* is accurately concentric with its opposite cylindrical end portions 12*u*, 12*b*.

Figure 3:
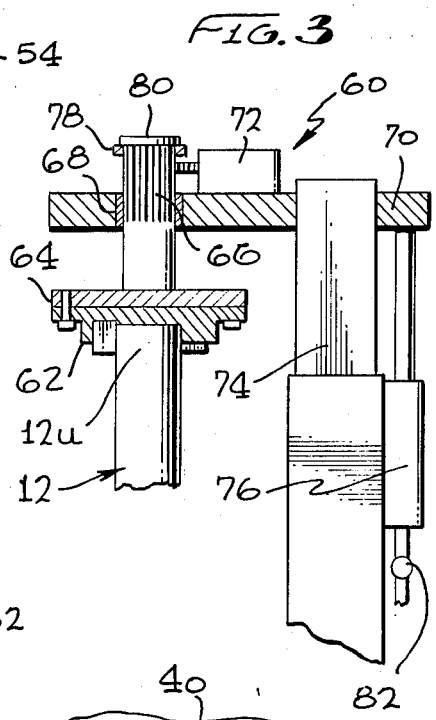
FIG. 3 is a partial sectional side view of an apparatus of another embodiment of the invention.

FIG. 3 illustrates another drive mechanism 60 which can be used to rotate the rod 12, while permitting it to expand and to even support some of the rod weight. The upper end 12*u* of the rod is held by a chuck 62 fastened to a plate 64 at the lower end of a splined shaft 66. The shaft rotates within a radial bearing 68 on a platform 70. A gearhead motor 72 mounted on the platford has an output gear connected to the splined shaft to turn it. The platform is guided in vertical motion by a telescoping post 74, and is urged upward by a hydraulic actuator 76.

The pressured hydraulic fluid in the cylinder of the actuator 76 is maintained at a level to support the entire weight of the platform 70 and the motor 72 thereon, as well as the movable portion of the post 74. In addition, the hydraulic pressure supports a portion of the weight of the rod 12, such as half of it. The upward force on the platform is transmitted through a bearing 78 on a U-shaped member, to a flange 80 on the splined shaft. Close control of pressure is achieved by applying a hydraulic pressure to the actuator 76 at a level above that required, and by using an accurate relief value 82 for drawing hydraulic fluid into a return line.

Thus, the invention provides a method and apparatus for flame spray coating a long and thin workpiece, which minimizes or avoids slight lateral deformation of the workpiece that would result in an uneven coating thickness after finishing. This is accomplished by mounting the workpiece so it rotates about a vertical axis instead of a horizontal one. This can be accomplished by mounting chuck devices at opposite end portions of the workpiece, with the chuck devices able to rotate about a vertical axis, and with one of them being driven to rotate the workpiece. Of course, a variety of chuck devices can be used to rotatably hold the workpiece, including a stationary lathe center that lies in an axial hole at the end of the workpiece. The chuck device is mounted so it can move vertically to accommodate expansion and contraction of the heated workpiece, and a biasing means is provided to apply an upward bias to the chuck device, to avoid excessive compressive loading of the workpiece that might result in buckling. The vertical mounting, which takes advantage of the fact that no appreciable bending occurs when a rod is loaded only in compression below a critical load, results in minimal deflection of the coated workpiece surface, to enable the finished artical to be manufactured with a substantially uniform coating and at relatively low cost.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. A spray flame coating apparatus comprising:

a frame;

upper and lower chucks rotatably mounted on said frame to rotate about a predetermined vertical axis;

means for moving heating and flame spray coating apparatus parallel and adjacent to said vertical axis; and means for rotating one of said chucks;

at least one of said chucks being moveable vertically along said axis to permit expansion and contraction of a workpiece as it is heated and cooled by said heating and flame spray coating apparatus.

2. A method for coating a long and thin workpiece having a workpiece axis extending along its length, comprising:

rotating said workpiece substantially about said workpiece axis while heating said workpiece to a temperature that significantly reduces its bending strength and flame spray coating it;

said axis being substantially vertical during said steps of heating and coating.

3. The method described in claim 2 including:

holding opposite ends of said workpiece by a pair of chuck devices, and supporting one of said chuck devices so it can move toward and away from the other chuck device.

4. The method described in claim 2 including:

clamping the upper end of said workpiece to a rotatable chuck device, applying an upward bias to said chuck device, and allowing the upper end of the chuck device to move toward and away from the lower end of the workpiece while it rotates.

5. In a flame spray coating system which includes heating and flame spray coating apparatus, the improvement of means for rotatably supporting a workpiece comprising:

an upper platform;

an ajustable post means for guiding said platform in vertical movement, and which includes a fluid-powered actuator for urging said platform upwardly;

a shaft rotatably mounted on said platform about a substantially vertical axis;

upper and lower chuck devices for engaging a workpiece, said upper chuck device mounted on said upper platform;

motor means for rotating one of said chuck devices; and means for maintaining a closely controlled fluid pressure in said actuator, which applies an upward force on said platform which exceeds the weight of said platform while the platform is stationary, whereby to support some of the weight of said upper chuck device and workpiece as the workpiece is being flame sprayed.

* * * * *